US005144897A

United States Patent [19]

Avery

[11] Patent Number: 5,144,897

[45] Date of Patent: Sep. 8, 1992

[54] SHIPPING PACKAGE COMBINATION

[75] Inventor: Ragnar R. Avery, Midland, Mich.

[73] Assignee: Dow Corning Corporation, Midland, Mich.

[21] Appl. No.: 764,867

[22] Filed: Sep. 24, 1991

Related U.S. Application Data

[63] Continuation of Ser. No. 654,426, Feb. 12, 1991, abandoned.

[51] Int. Cl.[5] ..... B65D 19/44

[52] U.S. Cl. ..... 108/55.3; 206/386

[58] Field of Search ..... 108/51.1, 55.3, 55.1, 108/901; 206/386

[56] References Cited

U.S. PATENT DOCUMENTS

| | | | |
|---|---|---|---|
| 3,628,468 | 5/1970 | Angelbeck, Jr. | 108/53 |
| 3,636,888 | 1/1972 | Angelbeck, Jr. | 108/51 |
| 3,948,190 | 4/1976 | Cook et al. | 108/53 |
| 3,993,168 | 11/1976 | Kubick | 108/53.1 |
| 3,995,749 | 12/1976 | Haskins | 108/53.1 |
| 4,000,704 | 1/1977 | Griffin, Jr. | 108/53.1 |
| 4,263,855 | 4/1981 | Lawlor | 108/53.3 |
| 4,516,677 | 5/1985 | Rowland | 206/394 |
| 4,838,176 | 6/1989 | Bowser | 108/53.3 |
| 5,052,307 | 10/1991 | Morrison | 108/53.1 |

FOREIGN PATENT DOCUMENTS

| | | | |
|---|---|---|---|
| 224559A1 | 7/1985 | Fed. Rep. of Germany | |
| 2175878 | 12/1986 | United Kingdom | 306/386 |

*Primary Examiner*—Gerald A. Anderson

*Attorney, Agent, or Firm*—Alexander Weitz

[57] ABSTRACT

A shipping combination is disclosed wherein a conventional wooden pallet capable of supporting a plurality of barrels is removably affixed to a tray, having essentially the same shape and dimensions as said pallet, for receiving said barrels. The tray has a plurality of raised abutments projecting from its interior surface for engaging the vertical outside surfaces of the barrels, thereby maintaining said barrels in a substantially fixed relative position.

5 Claims, 4 Drawing Sheets

SHIPPING PACKAGE COMBINATION

This is a continuation of copending application Ser. No. 07/654,426 filed on Feb. 12, 1991, now abandoned.

FIELD OF THE INVENTION

The present invention relates to a shipping combination used to transport and store drums or barrels. More particularly, this invention relates to a combination of a conventional pallet and a like dimensioned tray having a plurality of restraining abutments which maintain the drums or barrels in a substantially fixed relative position.

BACKGROUND OF THE INVENTION

The traditional method for transporting and storing drums or barrels in commerce utilizes various forms of pallets upon which the drums or barrels are stacked, the latter two terms of the art being illustrative of containers and these terms being used interchangeably herein. Conventionally, such containers are in the shape of a right circular cylinder, but need not be so. Thus, containers can be easily and efficiently moved about in locations such as a warehouse, a trailer, a loading dock, a factory floor, and the like, using a fork-lift truck. Conventional pallets for this purpose have been traditionally made of wood, largely based on its relative availability, strength and modest cost. However, wood pallets suffer from drawbacks such as poor resistance to chemical spills and rotting/warpage due to environmental exposure, and they do not provide any constraint for drums under high vibration conditions. Therefore, several modern designs have focused on the use of plastic pallets in an attempt to overcome some of the above disadvantages. Advances in this art have addressed some of the structural shortcomings of such plastic pallets as well as the desirability of stackable and nestable systems.

For example, in U.S. Pat. Nos. 3,628,468 and 3,636,888, Angelbeck discloses plastic pallets which have restraining means for maintaining four drums in position. The bottoms of these pallets are designed to engage the tops of the drums and thus allow for stable stacking.

In U.S. Pat. No. 3,948,190, Cook et al. disclose a plastic pallet formed from an integral sheet of material. These pallets are capable of carrying four drums in a relatively fixed position and can be nested for easy storage.

Kubick, in U.S. Pat. No. 3,993,168, teaches the construction of pallets having stepped edges to allow for drums of varying diameters. This system also offers integrally formed reinforcing struts extending transversely between adjacent vertical walls to inhibit transverse deflection of the pallet.

In U.S. Pat. No. 4,000,704, Griffin describes a pallet molded from a single sheet which can serve as either a top or a bottom support tray for a shipping container. These trays can be nested to conserve space when dealing with empty trays. They also incorporate interlocking means to limit lateral shifting of one tray with respect to another when loaded in a stacked configuration.

Lawlor, in U.S. Pat. No. 4,263,855, discloses a molded nesting pallet for barrels or drums having four-way entry so as to position the tines of a fork-lift truck essentially below the centers of gravity of the individual barrels or drums. The load bearing surfaces of the pallet are provided with channels which aid in the proper positioning of the cylindrical containers.

U.S. Pat. No. 4,516,677 to Rowland et al. teaches a pallet fashioned from a moldable material for transporting yarn packages having tubular cores. The pallet includes a repeating pattern of nubs upstanding from its top surface and a repeating pattern of depressions in its bottom surface which tracks the nub pattern. The nubs and depressions receive the tubular cores. The top and bottom pallets thus cooperate with the yarn package cores to provide a stable unit.

Bowser et al., in U.S. Pat. No. 4,838,176, disclose plastic foam pallets which are stackable or nestable by rotating alternate pallets 180° about a vertical axis perpendicular to the loading surface.

Although the above cited art teaches plastic pallets having various advantages over traditional wood pallets, it has been found that many of these systems simply do not satisfy the strength and rigidity requirements of the chemical industry. For for example, chemical barrels typically weigh upwards of 500 pounds. Four such barrels are generally loaded on one pallet and two or three such loaded pallets are typically stacked, one on top of the other. The effect of lateral vibrations sustained during shipping, superimposed on the already high stress experienced by the bottommost pallet of such a stacked configuration, is often excessive for some of the above designs. Deformation of the plastic pallets under such loads, even when insufficient to result in complete buckling thereof, can permit transported drums or barrels to shift and contact each other or the sides of trailers, for example. Such contacts often result in damage to the drums or barrels, particularly in the case of containers having reinforcing chines which are vulnerable due to their protruding surfaces. To a degree, of course, these concerns can be addressed by fabricating the pallets from thicker gage sheets, which improves their rigidity. However, such an approach can result in a plastic pallet which is not only expensive and too heavy for facile handling, but one which also extracts a high societal cost by depleting a non-renewable resource.

Furthermore, empty barrels must often be transported in chemical industry operations (e.g., new barrels sent to a manufacturing site or return of empty ones to original supplier for refill). These barrels are also susceptible to damage due to vibrations sustained during shipping of stacked barrel/pallet combinations. Unlike the situation when filled barrels are shipped and pallet deformation can result, the reduced weight of the empty barrels actually contributes to their mutual collisions and the barrel/pallet combinations typically have to be banded and/or shrink wrapped with spacers inserted between barrels in order to prevent damage from barrel-barrel contact and/or exposure to the environment.

SUMMARY OF THE INVENTION

Some of the above mentioned drawbacks of conventional wooden pallets and state-of-the-art plastic pallets have now been overcome in the shipping combination of the present invention. Accordingly, there is provided an article of manufacture for storing and shipping barrels or drums, wherein a relatively thin, lightweight, molded plastic tray is removably affixed to a conventional wooden (or plastic) pallet. These two structures cooperate with one another such that the conventional pallet essentially bears the full load of the barrels or drums while the tray acts to locate these containers in a fixed relative position thereon to prevent damage of the drums or barrels. Furthermore, the tray protects the conventional pallet, and the containers thereon, from chemical spills as well as environmental precipitation by catching and retaining inadvertently spilled liquids therein. The shipping combination of the present invention is believed to advance the art since, in addition to the above named advantages, it allows for the more effective utilization of the great number of conventional wooden pallets currently being used in commerce, and accomplishes this without further modification of the pallets. Additionally, the instant shipping combination has been shown to effectively reduce or eliminate damage to full as well as empty barrels during shipment, this desired objective being accomplished without resorting to the above mentioned banding, shrink-wrapping or spacer methods.

The present invention therefore relates to a shipping combination of a pallet capable of supporting a plurality of barrels and a tray of essentially the same dimensions as said pallet for receiving said barrels, said tray having a plurality of molded-in raised abutments projecting from its interior surface, said abutments having walls suitable for engaging the vertical outside surfaces of said barrels, thereby maintaining said barrels in a substantially fixed relative position.

DETAILED DESCRIPTION OF THE INVENTION

In its most general form, the shipping combination of the present invention comprises a conventional pallet, capable of supporting a plurality of barrels, to which there is removably affixed a tray, having essentially the same shape and dimensions as said pallet, for receiving said barrels, said tray having a plurality of raised abutments projecting from its interior surface for engaging the vertical outside surfaces of said barrels, thereby maintaining said barrels in a substantially fixed relative position.

The conventional pallet to be used in the present invention may be fabricated from a moldable plastic, as discussed above. More preferably, however, the pallet of the instant shipping combination is a traditional wooden type which is well known in the art.

Preferably, the tray of the present shipping combination comprises a generally planar deck having an upwardly extending exterior wall portion on its outside edges. There is at least one raised first abutment located at the center of the tray, this abutment being upwardly disposed from the interior surface thereof. Additionally, a plurality of raised second abutments, likewise disposed from the tray's interior surface, are located along the interior intersections formed between said deck and said wall. Each of the first and second abutments have at least one wall area for engaging the vertical outside surfaces of the barrels. The abutments are arranged so as to cooperatively constrain the movement of the barrels. For example, in the case of round barrels, the abutments can be disposed along a generally circular locus such that the walls of said abutments engage the arcuate vertical surfaces of the barrels. Similarly, when rectangular containers are to be used, the abutments are located along a generally rectilinear locus, and so forth.

The skilled artisan will readily appreciate that the tray of the present invention may be configured to hold a variable number of containers disposed about the central first abutment (abutments), an appropriate number and distribution of said second abutments being provided to assure that the containers are maintained in a relatively fixed position on the tray when placed within the boundary formed by said first abutment(s) and said second abutments. However, for the purposes of the present invention, it is preferred that four barrels are located symmetrically within the four quadrants of a essentially square tray.

Figure 1:
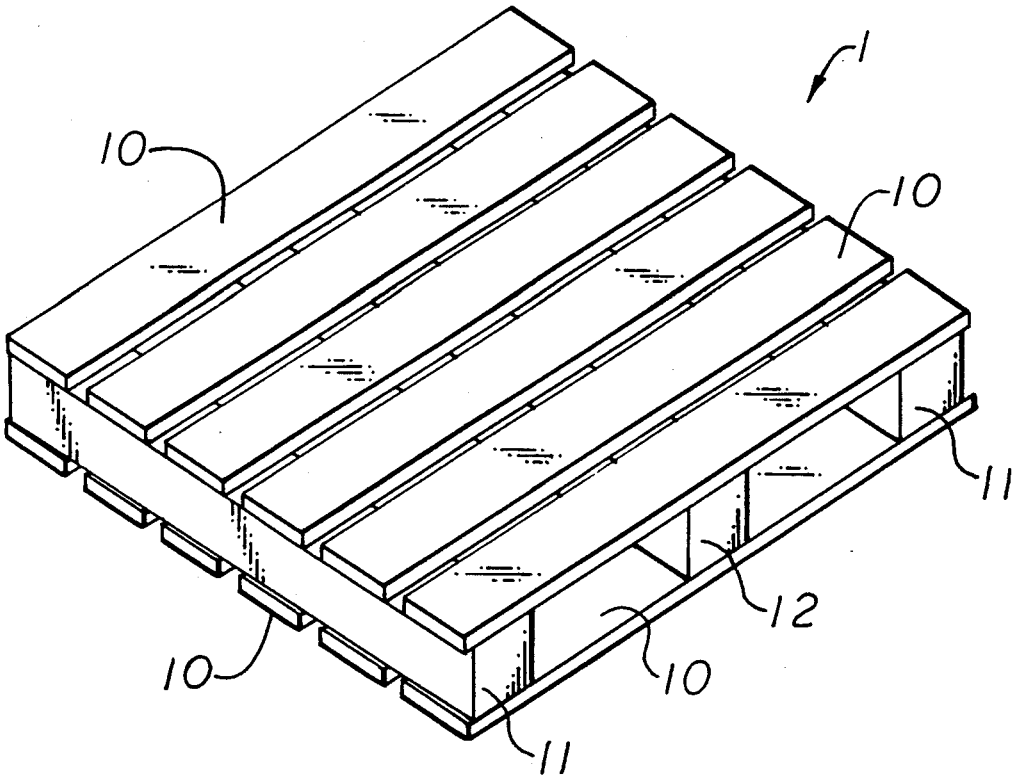
FIG. 1 is a perspective view of a conventional wooden pallet.
Figure 2:
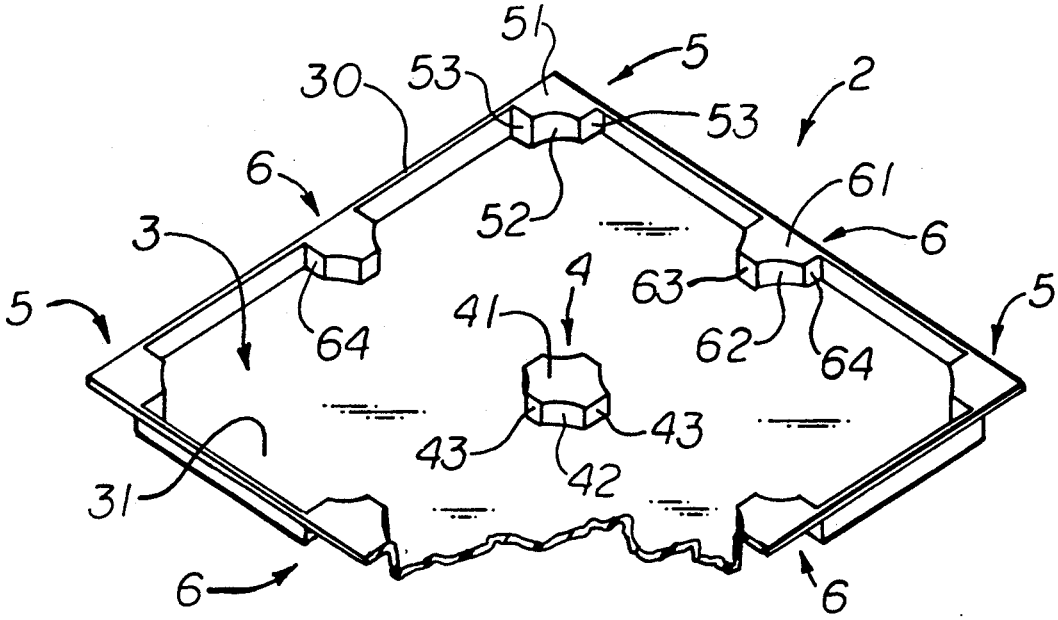
FIG. 2 is a cutaway perspective view of a preferred embodiment of a tray of the invention.
Figure 5:
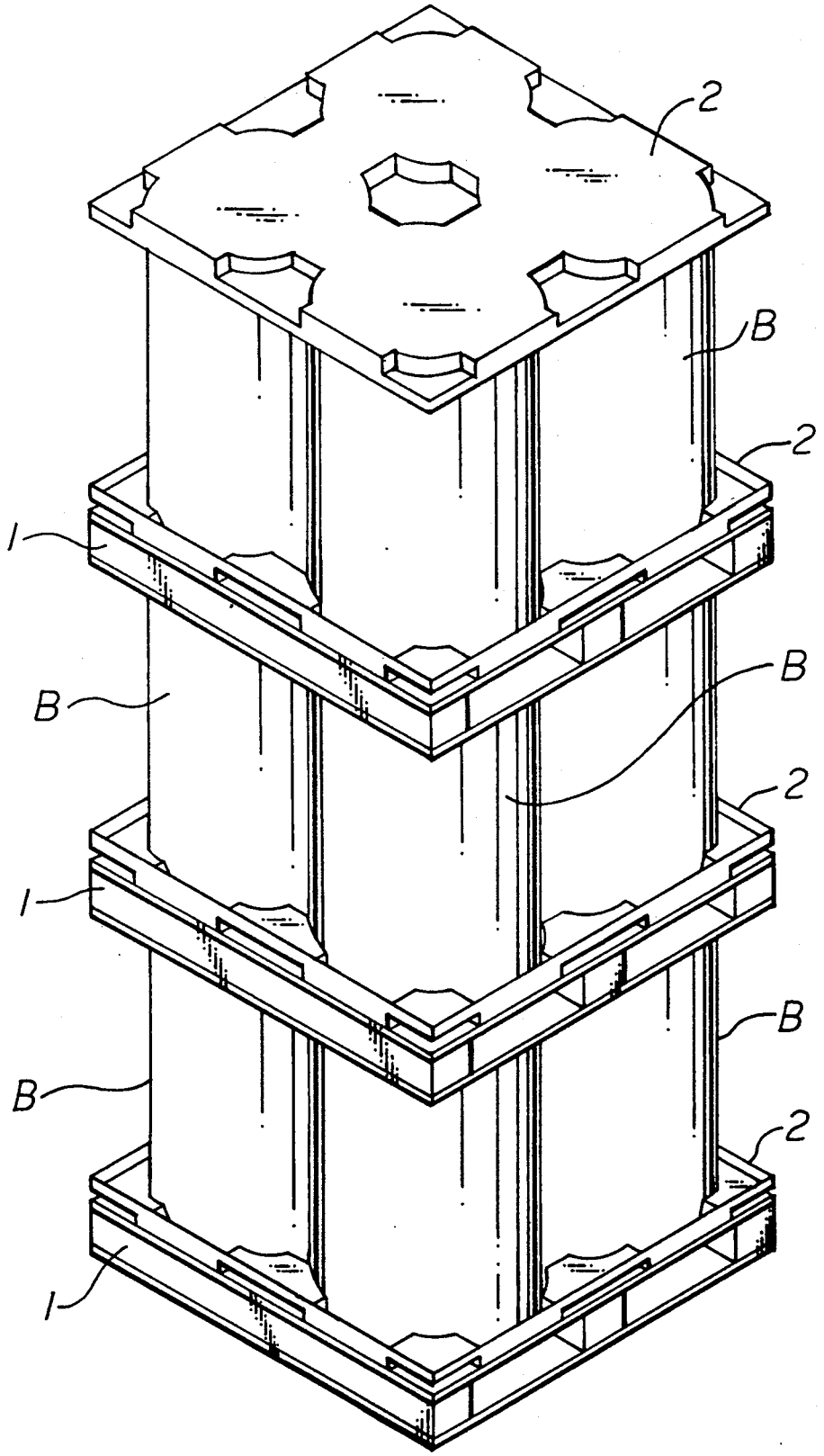
FIG. 5 is a perspective view of a preferred embodiment of the present invention showing a three-high stack of loaded pallet-tray shipping combinations. The pallet is that of FIG. 1 and the tray is that of FIG. 2, an additional tray herein acting as a cover for the top set of barrels.

Accordingly, in a preferred embodiment of the present invention, a conventional wooden pallet 1, shown in FIG. 1, is removably attached to a plastic tray 2, shown in FIG. 2, to form a shipping combination for round barrels B, as illustrated in FIG. 5.

Wooden pallet 1, illustrated in perspective view in FIG. 1, comprises a square-shaped bottom deck and a like-dimensioned square-shaped top deck, each deck being formed from a plurality of wood planks 10 which are disposed in a similar direction. These two decks are separated by two wooden edge beams 11 and one central beam 12, the longitudinal axes of said beams being disposed at 90 degrees from the longitudinal axes of said deck planks 10. Beams 11 and 12 are fastened to deck planks 10 in this configuration, thereby providing two cavities for the insertion of the tines of a fork-lift truck. Preferably, the wooden pallet has edge dimensions of 48 inches.

Figure 3:
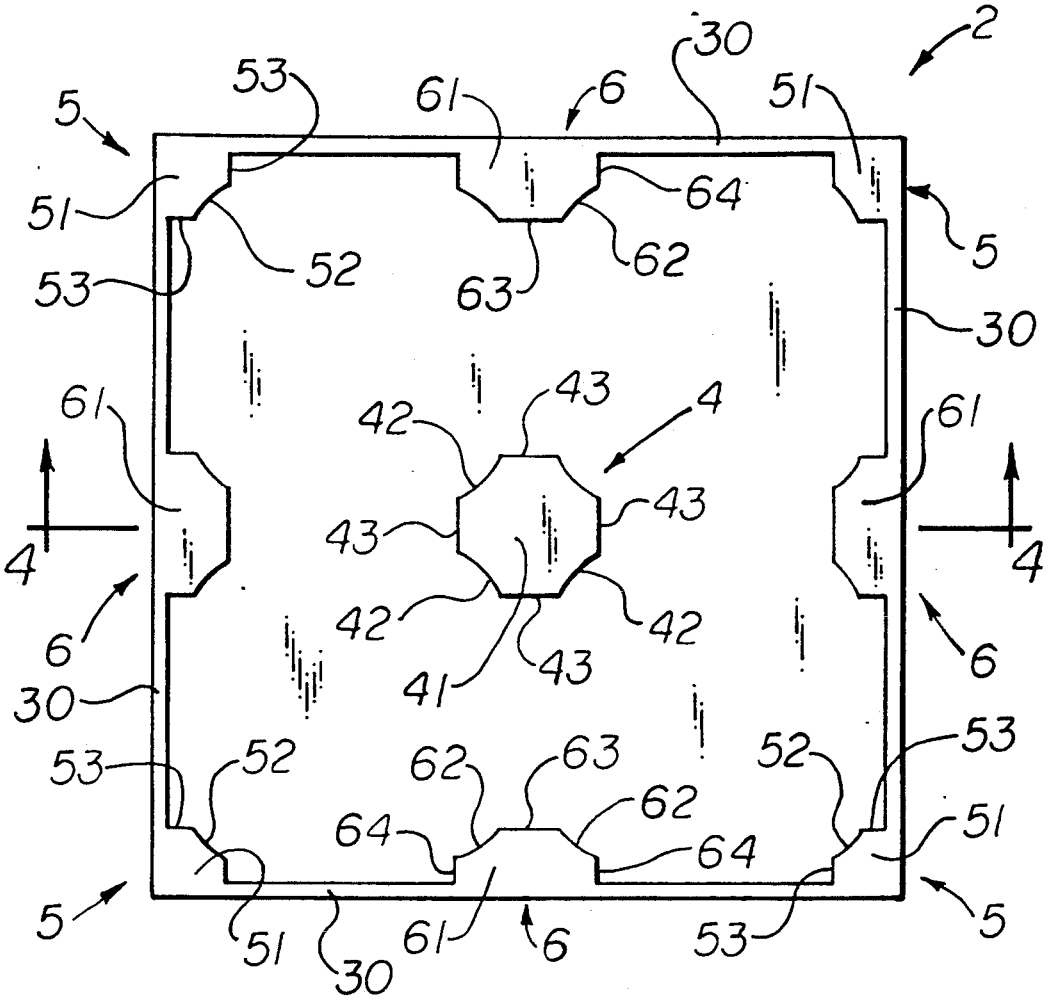
FIG. 3 is a top plan view of the tray shown in FIG. 2.
Figure 4:
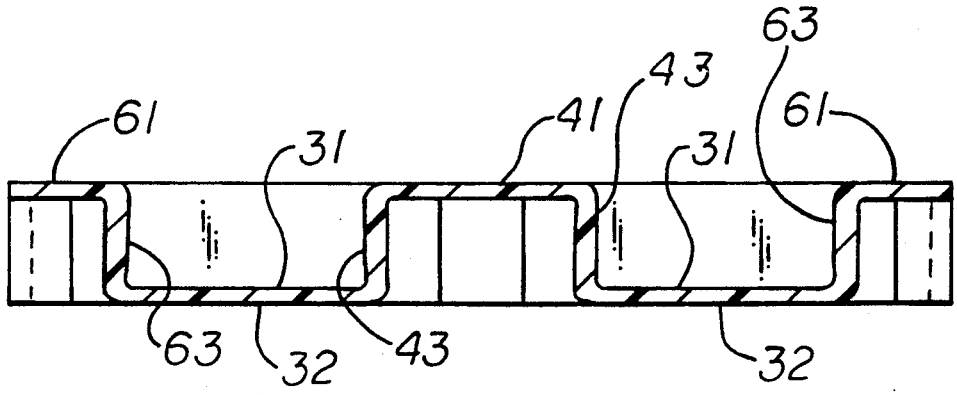
FIG. 4 is a cross-sectional view taken along line 4—4 of FIG. 3.

A preferred embodiment of tray 2 used in the shipping combination of the present invention, which is capable of holding four round barrels, is illustrated by a partial cutaway perspective view in FIG. 2, in top plan view in FIG. 3 and in cross-section in FIG. 4.

In the figures, the preferred tray 2 is shown to comprise an essentially square deck 3 having a top surface 31 and a bottom surface 32. Deck 3 has an upwardly extending exterior wall portion 30 on its outer edges. As noted above, this wall portion 30 assists in the containment of any liquid spills which may inadvertently emanate from barrels B. There is a raised central abutment 4 located at the center of the tray and upwardly disposed from its interior surface 31. This central abutment has a top surface 41, four flat walls 43 and four arcuate walls 42, the latter capable of engaging the arcuate vertical outside surfaces of the barrels B. Four similar raised abutments 5, having top surfaces 51 and flat walls 53 are located at the interior corners of the tray along the intersections of the deck 3 and wall portion 30. Each of these corner abutments has one arcuate wall 52 for engaging the vertical outside arcuate surfaces of the barrels B. Finally, four raised edge abutments 6 are located at the midpoints of the interior intersections of the deck 3 and the wall portion 30, each of said edge abutments 6 having one first flat wall 63, two second flat walls 64 and two arcuate walls 62, the latter again being designed to engage the vertical outside surfaces of the barrels. When a round barrel B is placed in each of the four quadrants of tray 2, as shown in FIG. 5, the rounded vertical outside surfaces thereof engage arcuate walls 42, 52 and 62 to maintain the barrels in a substantially fixed relative position. In this preferred embodiment, tray 2 is molded from a single sheet of plastic material by, e.g., a compression molding, injection molding or vacuum forming process. This results in a savings of material since the abutments can then be molded in the form of hollow structural shells. The cross-sectional view presented in FIG. 4 clearly illustrates the hollow nature of abutments 4 and 6 resulting from such a process. The cross-sectional thickness of the plastic sheet used to form the tray should be of a sufficiently high gage to assure that the abutments have adequate strength to withstand the shearing stress induced by shifting barrels during transport. Examples of suitable plastics which may be used to form tray 2 include high density polyethylene, filled polyethylene, structural polyethylene foam and ABS resins. It is highly preferred that tray 2 is vacuum formed from a single sheet of high density polyethylene having a thickness of about 0.2 inch.

Although all the walls of abutments 4, 5 and 6 may be essentially perpendicular to the deck surface 31, it is preferred that they are provided with a draft (i.e., taper) of about 4 to 6 degrees, most preferably 5 degrees, from a perpendicular drawn to the deck surface 31, resulting in slightly reduced dimensions for the top surface of each abutment relative to its base. This has the effect of not only facilitating the molding of the tray, but also allows for nesting a plurality of trays for shipping and storage purposes. As in the case of the preferred pallet 1, the preferred square tray has edge dimensions of about 48 inches. It is also preferred that abutments 4, 5 and 6, as well as wall 30, extend about 2.3 inches above said deck surface 31 (i.e., the height of the tray is preferably about 2.5 inches). The latter dimension has been found to facilitate the removal of barrels from the tray when using mechanical pick-up equipment to handle the barrels B.

Figure 6:
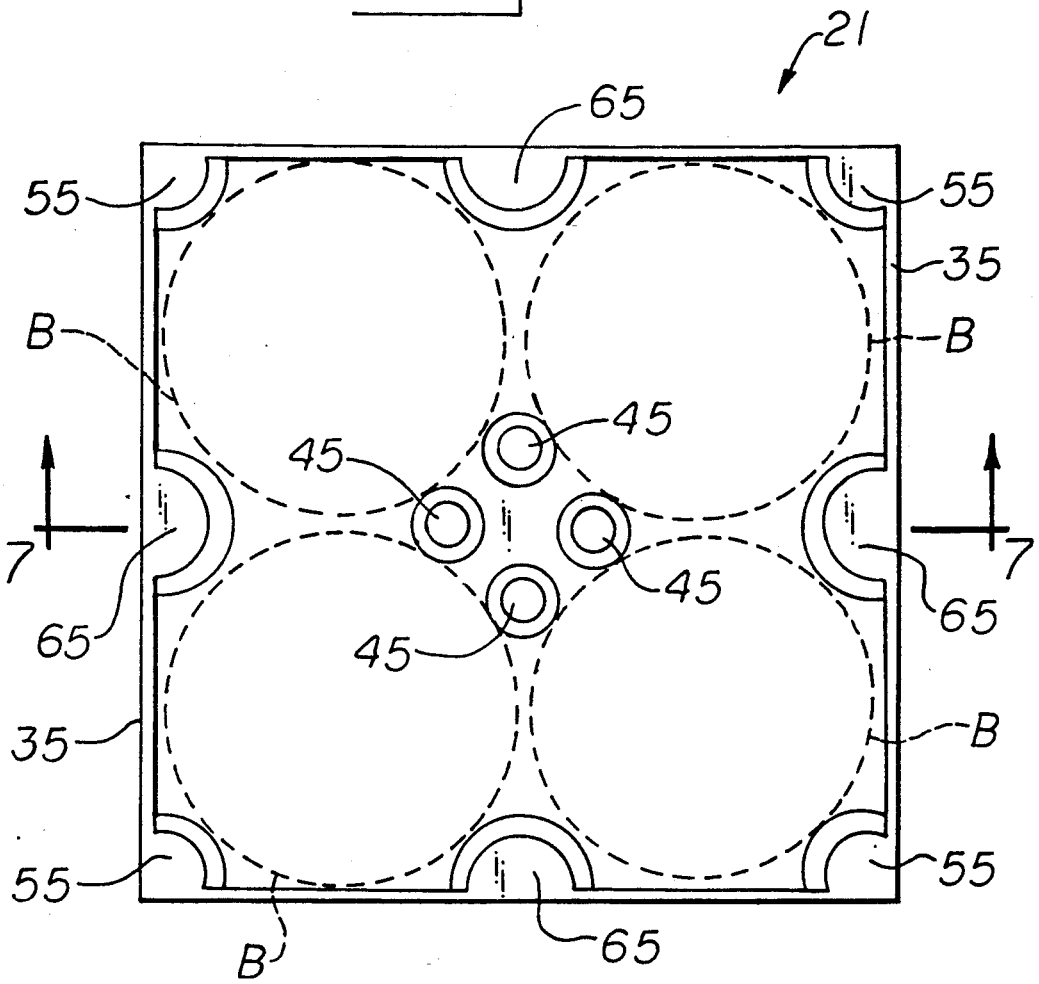
FIG. 6 is a top plan view of an alternate embodiment of the present invention.
Figure 7:
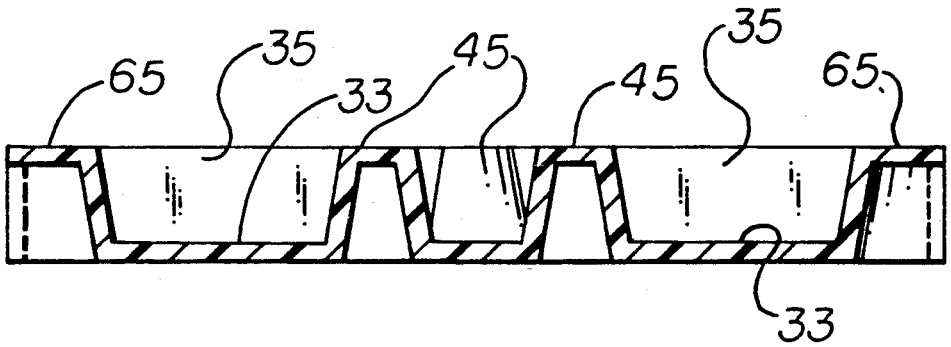
FIG. 7 is a cross-sectional view taken along line 7—7 of FIG. 6.

In an alternate embodiment of the tray of the present invention, illustrated in top plan view in FIG. 6 and in cross-sectional view along line 7—7 in FIG. 7, the abutments which restrict the relative displacement of barrels B within the tray are of a generally truncated-conical shape. Thus, a series of central abutments 45 is again disposed at the center of the tray 21, four corner abutments 55 are located at the intersections of interior deck surface 33 with the wall section 35 and four edge abutments 65 are equally spaced between the corner abutments 55 and along the intersections of deck surface 33 and wall section 35. The central abutments 45 in this embodiment are truncated cones having a slight draft angle and abutments 55 and 65 are portions of truncated cones having a similar draft. The dotted line representation of barrels B in FIG. 6 again illustrates the placement thereof within the tray and the interaction of the arcuate surfaces on the barrels B with the walls of the various abutments so as to prevent substantial relative movement of the barrels.

In order to utilize the shipping combination of the present invention, pallet 1 is removably attached to tray 2 such that the edges of these two structures are essentially aligned. The mode of attachment is not critical and means such as bolts, screws, nails, staples, and the like, are suitable for this purpose. Preferably, the tray is stapled to the pallet in view of the simplicity of this method. Barrels B may then be loaded onto the shipping combination by hand or mechanically, depending on the weights involved. Two or three such loaded systems may be stacked, as shown in FIG. 5. Preferably, an extra tray is inverted and used to cap the top-most set of barrels, as in FIG. 5, to further stabilize the stacked configuration and to protect it from environmental damage. Whether the barrels are full or empty, the shipping combination of the present invention has been shown to reduce damage during transport both from barrel-barrel interaction as well as abrasion and chipping due to contact with the walls of trucks in which the stacked systems are shipped.

That which is claimed is:

1. A shipping combination comprising:

(i) four round liquid-containing barrels, said barrels having vertical outside surfaces;

(ii) a square wooden pallet capable of supporting said barrels; and (iii) an essentially square tray supported by said pallet and having essentially the same length and width dimensions as said wooden pallet for receiving said barrels, said tray being formed from a single sheet of molded plastic material and having (a) an interior surface having a center and four outside edges;

(b) an upwardly extending, liquid-retaining, exterior wall portion along said outside edges, said tray further having four interior corners and four midpoints which are located between said corners and at the intersection of said wall portion with said interior surface;

(c) a raised central abutment located at the center of said interior surface and upwardly disposed from said interior surface, said central abutment having four arcuate walls for engaging the vertical outside surfaces of said barrels;

(d) four raised corner abutments located at the interior corners of said tray, each of said corner abutments having one arcuate wall for engaging the vertical outside surfaces of said barrels;

(e) four raised edge abutments located at the midpoints of said tray, each of said edge abutments having arcuate walls for engaging the vertical outside surfaces of said barrels, whereby said barrels are maintained in a substantially fixed relative position and said exterior wall portion retains any of said liquid which inadvertently leaks from said barrels.

2. The shipping combination according to claim 1, wherein the walls of said central abutment, said corner abutments and said edge abutments are provided with a draft of about 4 to 6 degrees from a perpendicular drawn to said interior surface.

3. The shipping combination according to claim 2, wherein said tray is molded from a single sheet of high density polyethylene.

4. The shipping combination according to claim 3, wherein said tray and said wooden pallet each have edge dimensions of approximately 48 inches.

5. The shipping combination according to claim 4, wherein said tray and said wooden pallet are joined with a plurality of removable staples.

* * * * *